US011767803B2

(12) United States Patent
Kumar et al.

(10) Patent No.: US 11,767,803 B2
(45) Date of Patent: Sep. 26, 2023

(54) INTERNAL COMBUSTION ENGINE SYSTEM

(71) Applicant: Powerhouse Engine Solutions Switzerland IP Holding GmbH, Zug (CH)

(72) Inventors: Kotha Ramesh Kumar, Bangalore (IN); John Patrick Dowell, Grove City, PA (US); Jason Lymangrover, Harborcreek, PA (US); John Roth, Millcreek Township, PA (US)

(73) Assignee: POWERHOUSE ENGINE SOLUTIONS SWITZERLAND IP HOLDING GMBH, Zug (CH)

( * ) Notice: Subject to any disclaimer, the term of this patent is extended or adjusted under 35 U.S.C. 154(b) by 0 days.

(21) Appl. No.: 17/355,028

(22) Filed: Jun. 22, 2021

(65) Prior Publication Data

US 2022/0010750 A1 Jan. 13, 2022

(30) Foreign Application Priority Data

Jul. 13, 2020 (IN) ..... 202041029646

(51) Int. Cl.
*F02F 1/10* (2006.01)
*F02F 1/00* (2006.01)
(Continued)

(52) U.S. Cl.
CPC ..... *F02F 1/004* (2013.01); *F02B 75/22* (2013.01); *F02F 1/16* (2013.01); *F02F 11/002* (2013.01); *F02F 11/005* (2013.01)

(58) Field of Classification Search
CPC ..... F02F 1/16; F02F 1/004; F02F 1/14; F02F 1/10; F02F 7/0007; F02F 1/40; F01P 2003/021
See application file for complete search history.

(56) References Cited

U.S. PATENT DOCUMENTS 4,474,147 A 10/1984 Hoopes
6,164,260 A 12/2000 Bock
(Continued)

FOREIGN PATENT DOCUMENTS

AT 1565 U1 * 7/1997
CN 207526601 U 6/2018
(Continued)

OTHER PUBLICATIONS

Patent Office of the Russian Federation—Federal Institute of Industrial Property, Office Action Issued in Application No. 2020135997(066350), dated Jan. 22, 2021, 9 pages.
(Continued)

*Primary Examiner* — George C Jin
*Assistant Examiner* — Teuta B Holbrook
(74) *Attorney, Agent, or Firm* — McCoy Russell LLP

(57) ABSTRACT

A system and method are provided for an internal combustion engine. An engine system, in one example, includes a cylinder liner positioned within an opening of a crankcase, including a surface biasing a landing surface of an undercut fillet of the crankcase, and including a cylinder opening and a seal arranged in a groove of the cylinder liner positioned axially above the undercut fillet. The engine system further includes a fluid gasket and a combustion gasket positioned between a cylinder head and the crankcase, the fluid gasket and the combustion gasket being decoupled from one another.

7 Claims, 13 Drawing Sheets

(51) Int. Cl.

| | |
|---|---|
| ***F02B 75/22*** | (2006.01) |
| ***F02F 1/16*** | (2006.01) |
| ***F02F 11/00*** | (2006.01) |

(56) References Cited

U.S. PATENT DOCUMENTS

| | | | | |
|---|---|---|---|---|
| 6,371,489 | B1 | 4/2002 | Combet et al. | |
| 9,482,178 | B2 * | 11/2016 | Batta | F02F 1/163 |
| 2005/0257756 | A1 * | 11/2005 | Endoh | F01P 3/02 123/41.79 |
| 2012/0240883 | A1 * | 9/2012 | McGiffin | F02F 1/16 123/41.72 |
| 2016/0097340 | A1 * | 4/2016 | Morgan | F02F 1/10 123/193.2 |

FOREIGN PATENT DOCUMENTS

| | | | | |
|---|---|---|---|---|
| DE | 1044515 | B | 11/1958 | |
| DE | 10205179 | A1 * | 8/2003 | F02F 1/102 |
| DE | 102012219808 | A1 | 4/2014 | |
| DE | 102019122743 | A1 | 10/2019 | |
| EP | 3670882 | A1 | 6/2020 | |
| GB | 2575036 | A | 1/2020 | |
| JP | S6346646 | U * | 3/1988 | |
| JP | 2000002151 | A | 1/2000 | |
| JP | 2003074450 | A * | 3/2003 | |
| SU | 294376 | A1 | 1/1971 | |
| WO | 2016159970 | A1 | 10/2016 | |

OTHER PUBLICATIONS

Patent Office of the Russian Federation—Federal Institute of Industrial Property, Office Action Issued in Application No. 2020135998/12(066319), dated Feb. 11, 2021, 12 pages.

* cited by examiner

INTERNAL COMBUSTION ENGINE SYSTEM

CROSS REFERENCE TO RELATED APPLICATIONS

The present application claims priority to Indian Patent Application No. 202041029646, entitled "INTERNAL COMBUSTION ENGINE SYSTEM," and filed on Jul. 13, 2020. The entire contents of the above-listed application are hereby incorporated by reference for all purposes.

BACKGROUND

Technical Field

The present description relates to a system and method for sealing engine cylinders and fluid passages.

Discussion of Art

Some engine gaskets provide combustion gas and fluid sealing functionality to reduce or prevent coolant from migrating into the combustion chamber and combustion gases from migrating into water jacket coolant. However, engine gaskets are exposed to relatively high temperatures as well as mechanical loading due to combustion forces, and to thermal expansion and contraction of the engine. Engine cylinder liners experience similar thermal and mechanical loading during engine operation. Gasket degradation may arise from the loading, leading in some cases to unwanted coolant and/or combustion gas leaks. Cylinder liner degradation may additionally occur due to the thermal and mechanical loading, causing abrasive wear of the piston and combustion chamber oil leaks.

It may be desirable to have a system and method that differs from those that are currently available.

BRIEF DESCRIPTION

In one example, an internal combustion engine system is provided. The internal combustion engine system includes a cylinder liner. The cylinder liner is positioned within an opening of a crankcase. The cylinder liner includes a surface biasing a lower surface of an undercut fillet of the crankcase and a cylinder opening. The internal combustion engine system further includes a seal arranged in a groove of the cylinder liner positioned axially above the undercut fillet. The undercut fillet includes a curved wall extending radially outward from a central axis of the cylinder opening. The internal combustion engine system further includes a water jacket traversing the crankcase. The water jacket has a passage extending below the undercut fillet and radially outward from the undercut fillet.

In another example, an internal combustion engine system is provided. The internal combustion engine system includes a combustion gasket. The combustion gasket is arranged between a cylinder head and a crankcase, has a polygonal cross-section, and circumferentially surrounds a cylinder. The combustion gasket provides a load path and seals combustion gases in the cylinder. In the internal combustion engine system, an inner side of the combustion gasket is positioned axially above an undercut extending in a downward direction in relation to a cylinder axis. The undercut includes a lower surface spaced away from a radial side of the combustion gasket when the combustion gasket is not loaded.

In another example, an internal combustion engine system is provided. The internal combustion engine system includes a fluid gasket arranged between a cylinder head and a crankcase. The fluid gasket includes two upper beads extending upward from a carrier in relation to a cylinder axis. Additionally, the fluid gasket includes two lower beads extending downward from the carrier in relation to the cylinder axis. The internal combustion engine system further includes a cylinder liner arranged in an opening of the crankcase and having a cylinder opening. The fluid gasket extends around a section of a passage in a water jacket axially traversing the crankcase.

DETAILED DESCRIPTION

The following description relates to an internal combustion engine system designed with increased combustion and fluid sealing capabilities and durability. To achieve these capabilities, fluid and combustion gaskets may be decoupled to tune the gaskets for the specific sealing needs near the combustion chamber and fluid passages, such as coolant and oil passages. The engine system may balance and tradeoff sealing capabilities and fatigue margins in components such as a cylinder liner and a crankcase. This may decrease the likelihood of component degradation and gas or fluid leaks.

Figure 2:
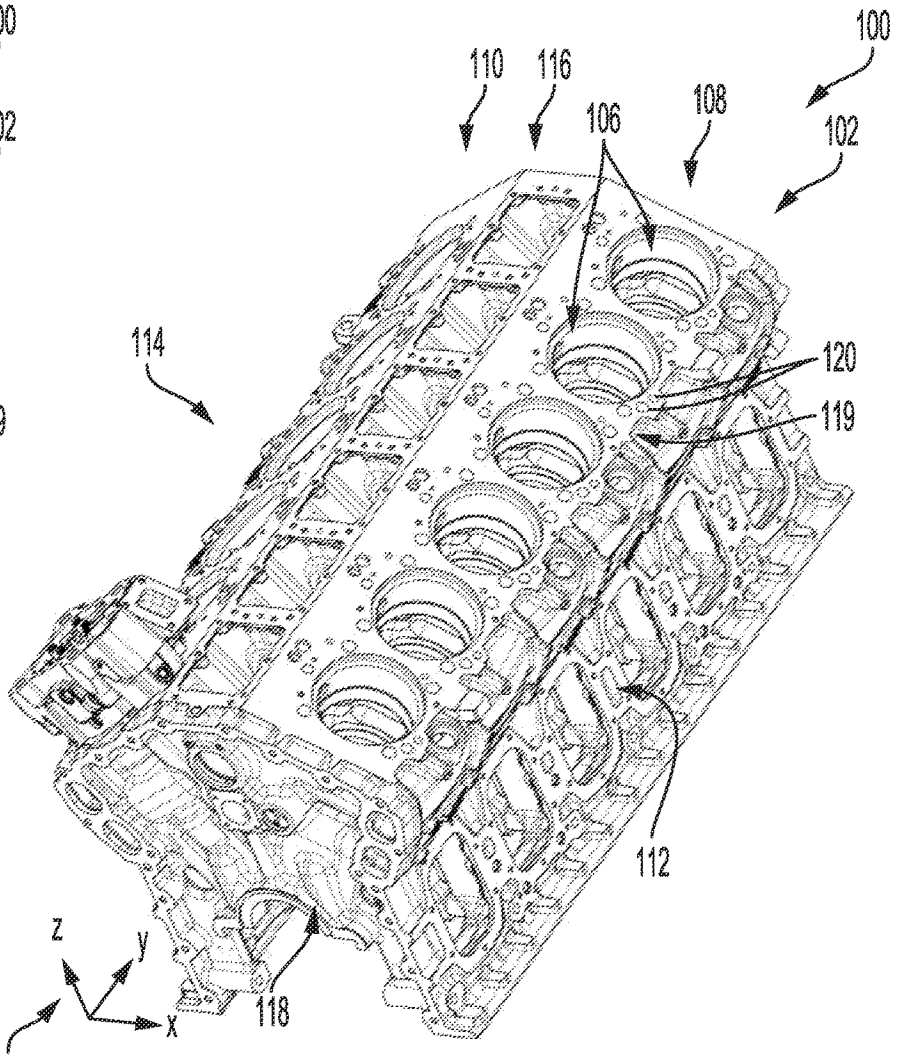
FIG. 2 shows the crankcase, depicted in FIG. 1, with the cylinder studs removed.
Figure 1:
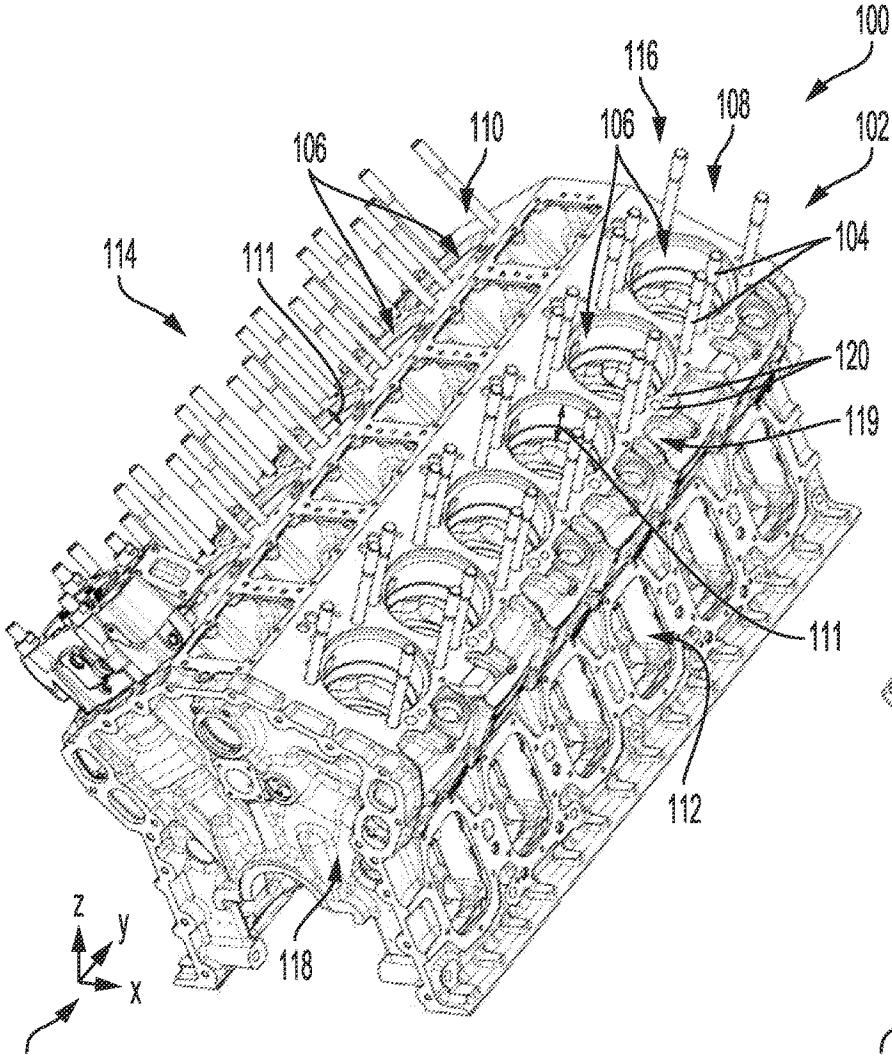
FIG. 1 shows a perspective view of an engine system with a crankcase and cylinder studs.
Figure 3B:
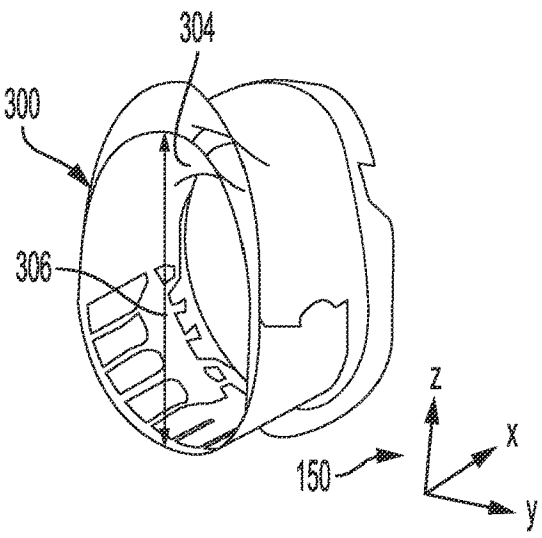
FIG. 3B shows a detailed view of a water jacket opening in the crankcase, depicted in FIG. 3A.
Figure 4B:
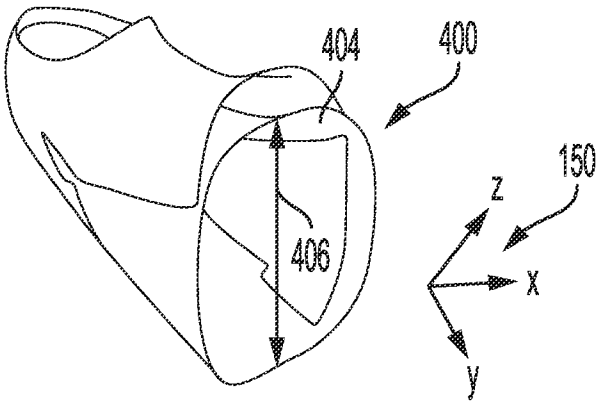
FIG. 4B shows a detailed view of a water jacket opening in the crankcase, depicted in FIG. 4A.
Figure 5:
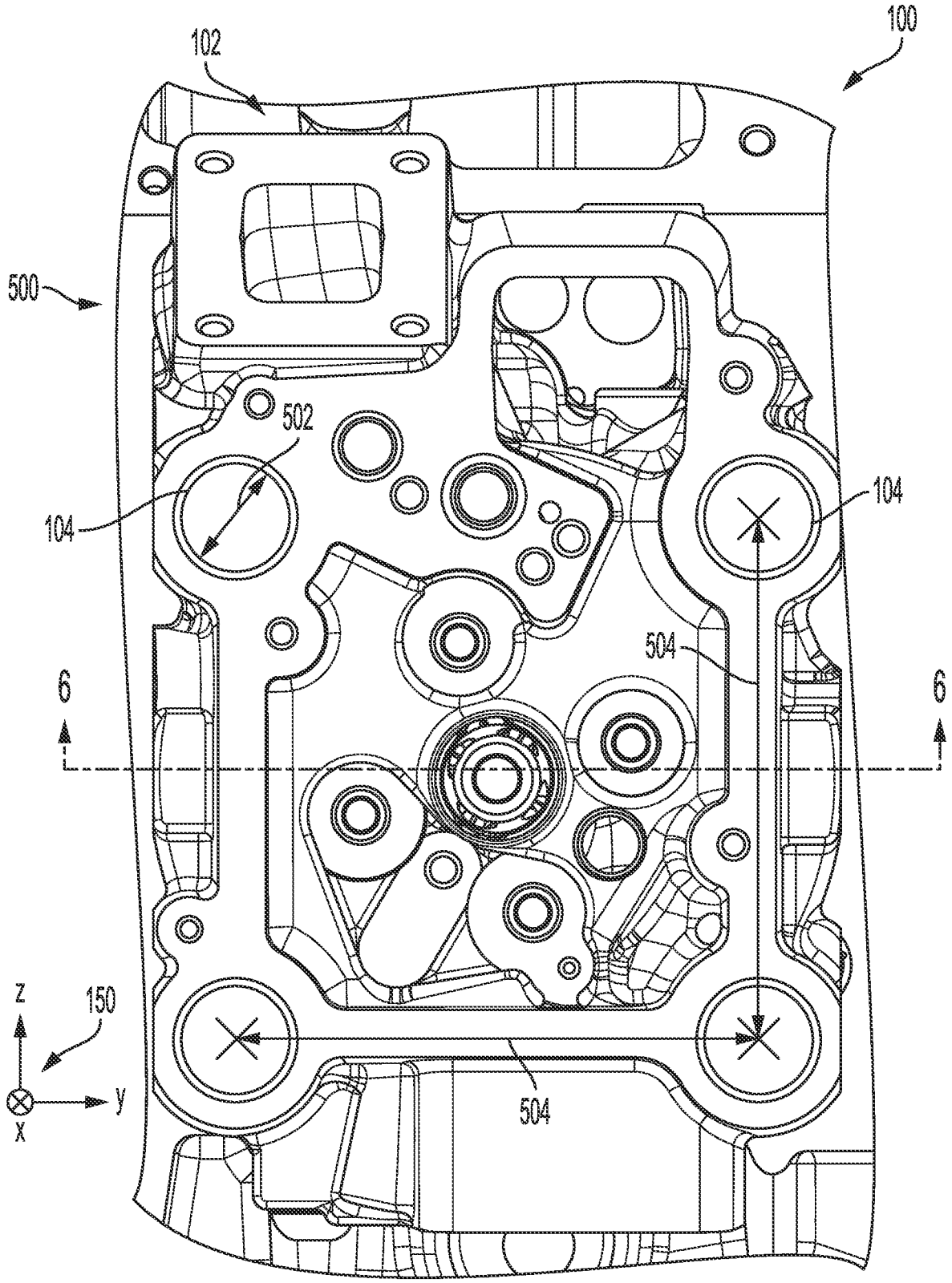
FIG. 5 shows the engine system with a cylinder head coupled to the crankcase, depicted in FIG. 1.
Figure 6B:
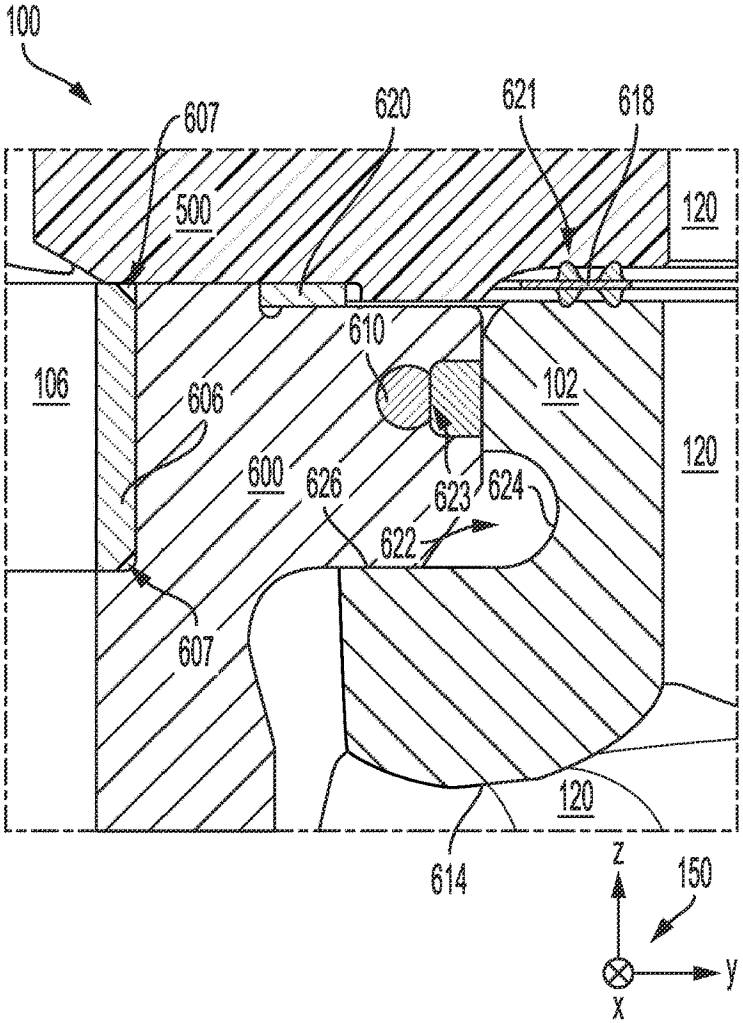
FIG. 6B shows a detailed view of a cylinder liner, the cylinder head, and the crankcase, in the engine system, depicted in FIG. 6A.
Figure 6A:
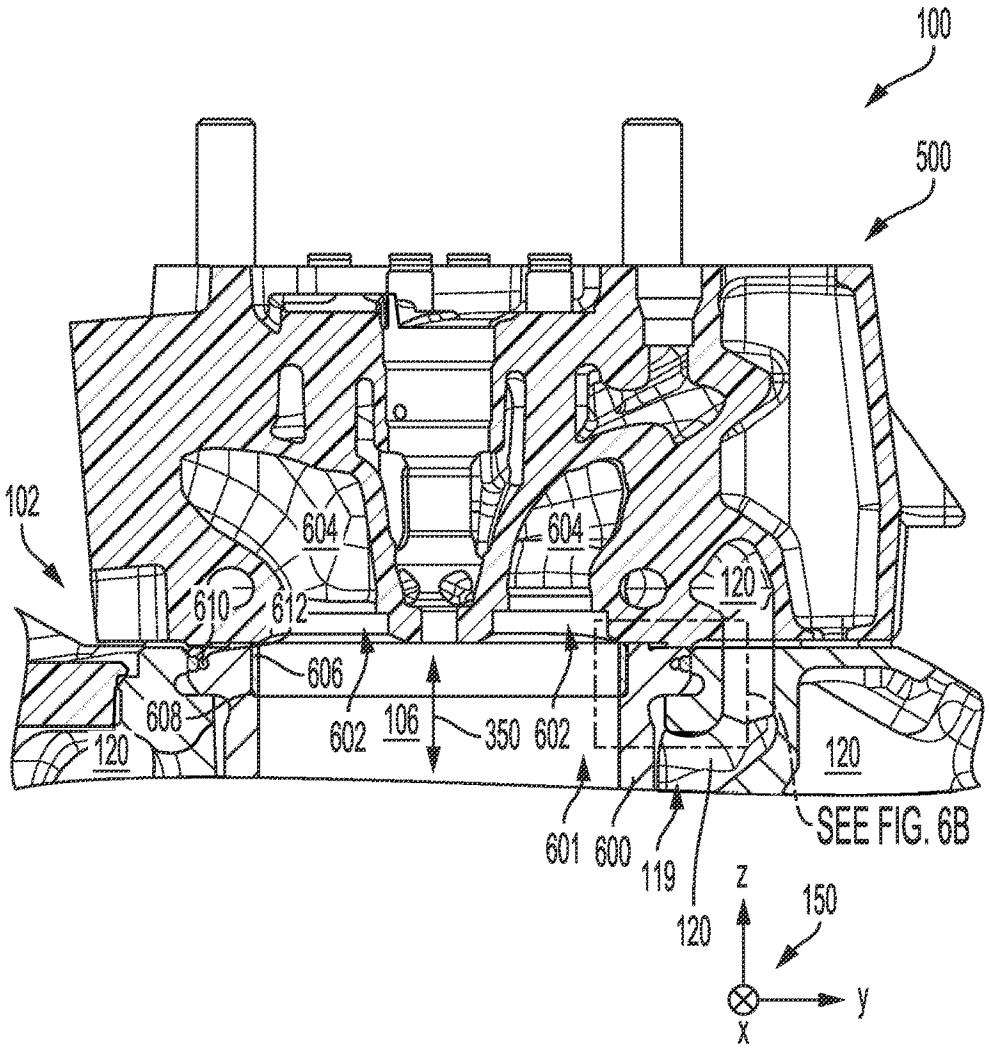
FIG. 6A shows a cross-sectional view of the engine system, depicted in FIG. 5.
Figure 7:
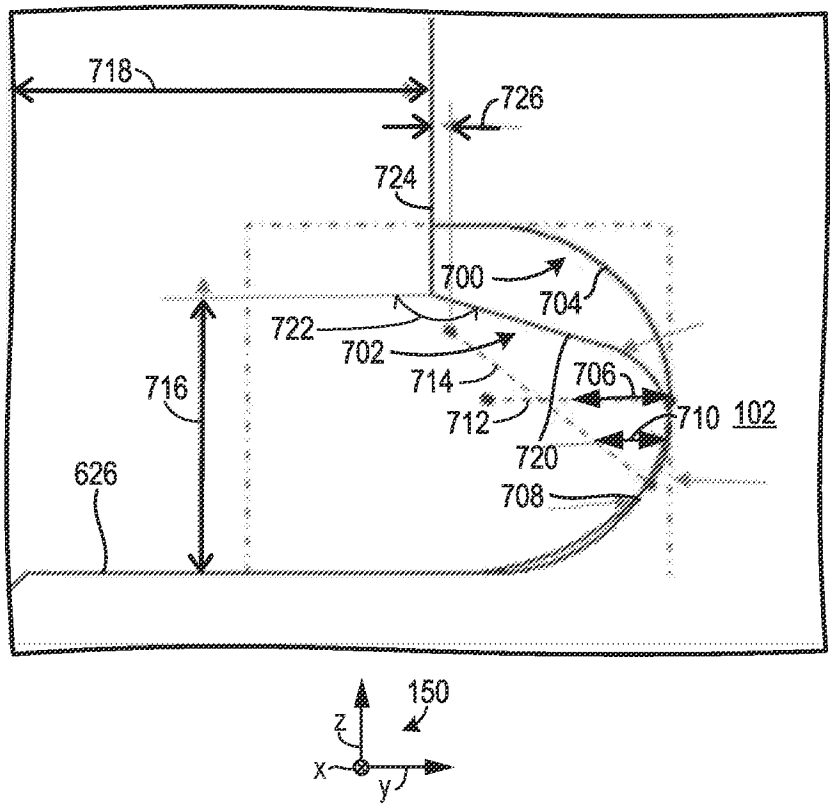
FIG. 7 shows a detailed view of embodiments of an undercut fillet in the crankcase, depicted in FIG. 6B.
Figure 12:
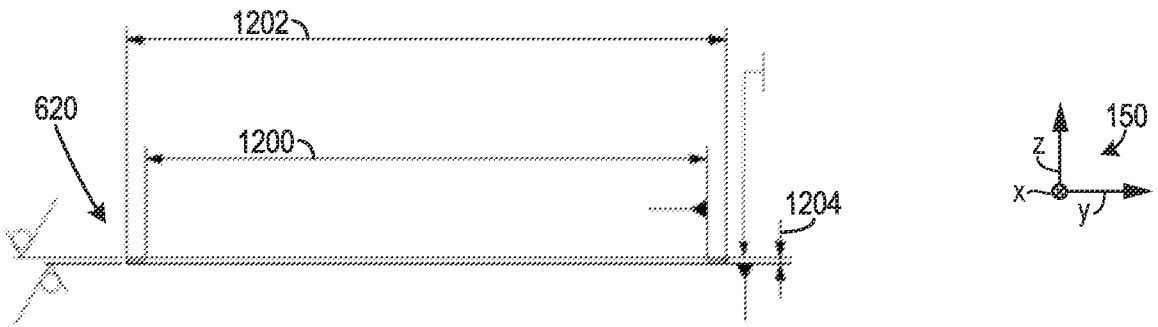
FIG. 12 shows a detailed view of a combustion gasket in the engine system, depicted in FIG. 6B.
Figure 13A:
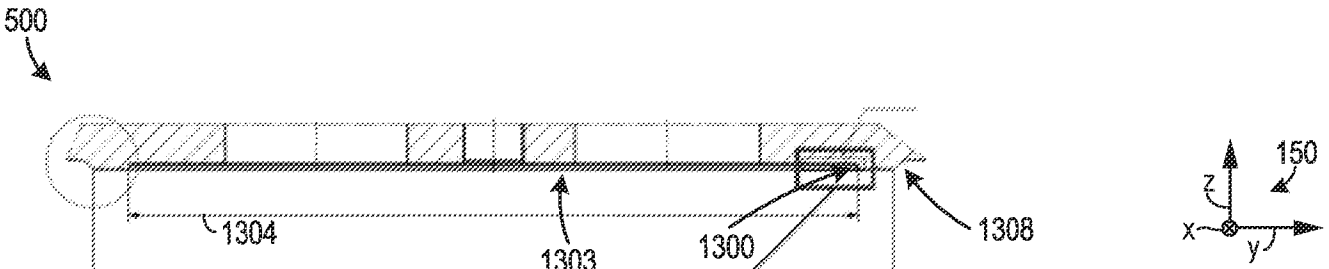
FIGS. 13A and 13B show detailed views of the cylinder head in the engine system, depicted in FIG. 6B.
Figure 13B:
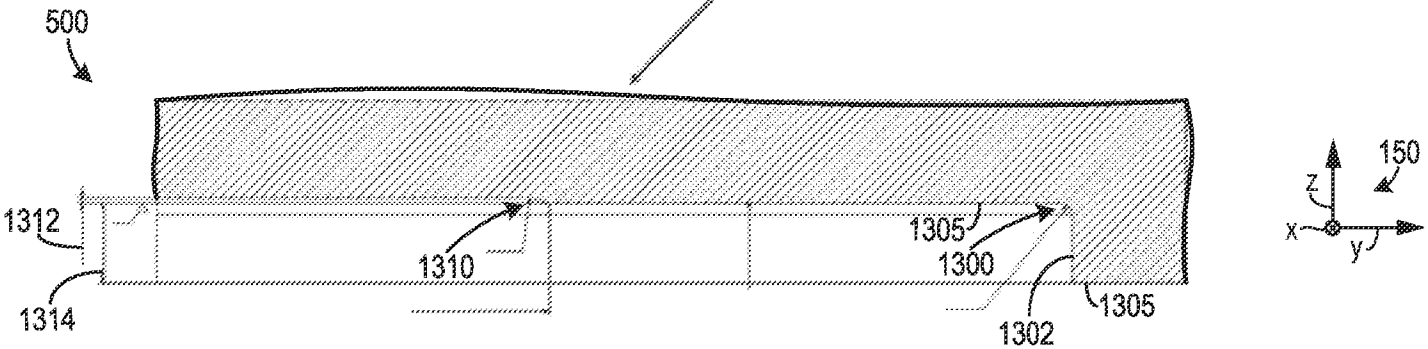
Figure 14:
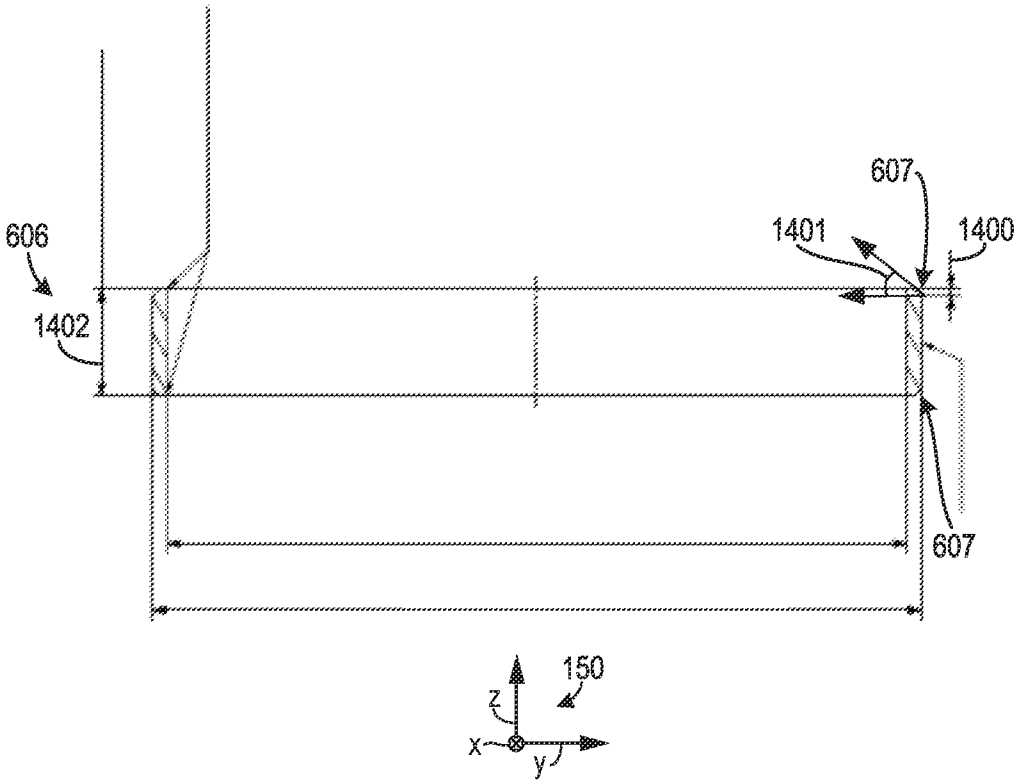
FIG. 14 shows a detailed cross-sectional view of a scraper ring in the engine system, depicted in FIG. 6B.
Figure 16:
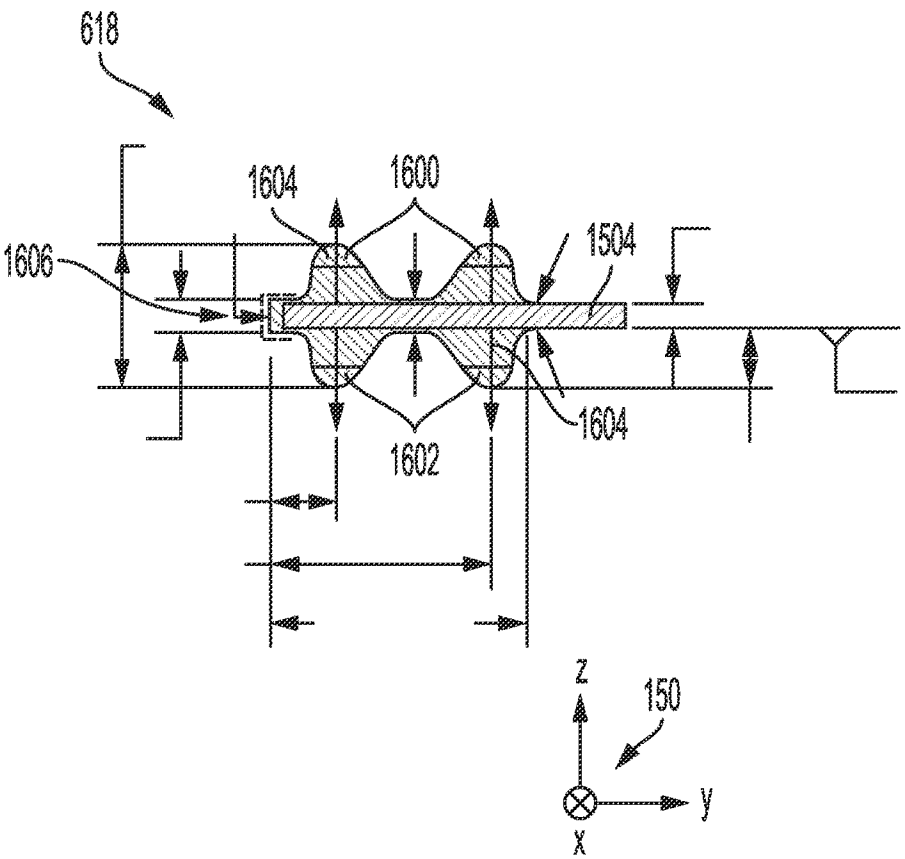
FIG. 16 shows a cross-sectional view of the fluid gasket, depicted in FIG. 15.
Figure 15:
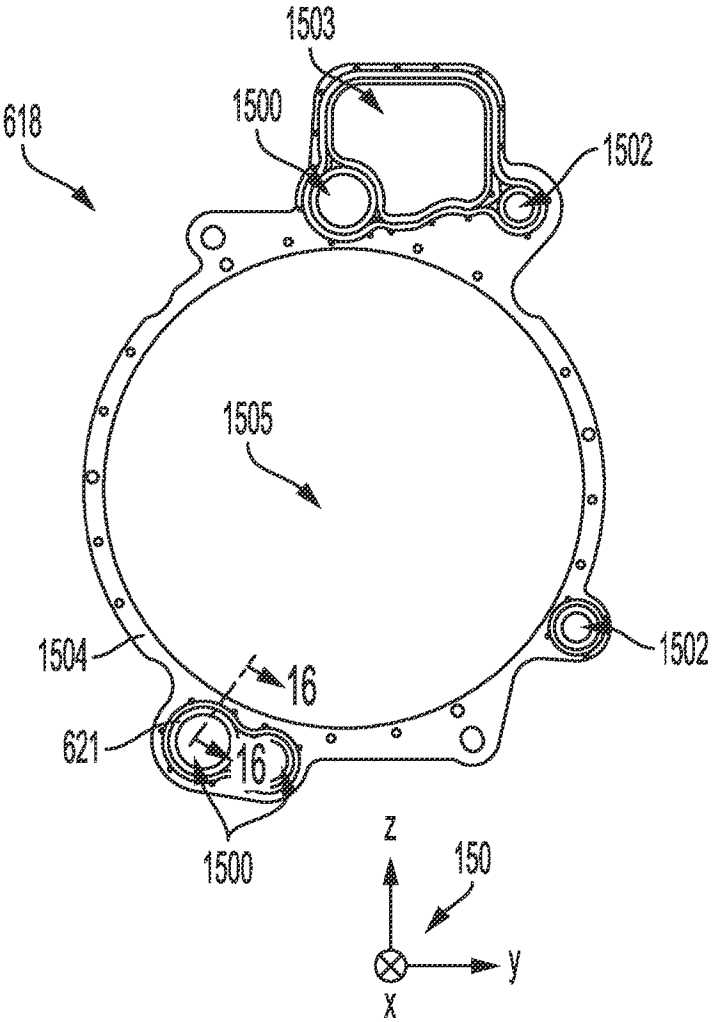
FIG. 15 shows a detailed view of a fluid gasket in the engine system, depicted in FIG. 6B.
Figure 20:
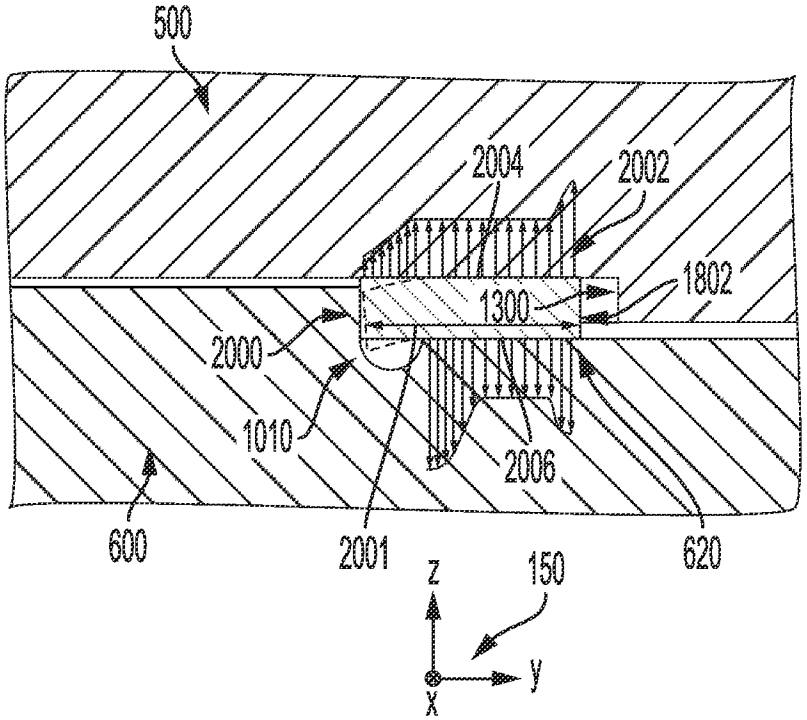
FIG. 20 shows a view of the combustion gasket, depicted in FIG. 19, in flexion.
Figure 19:
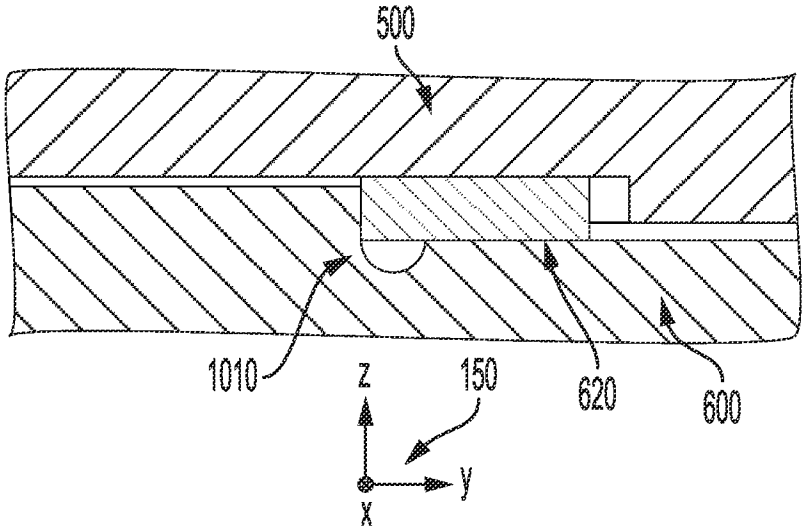
FIG. 19 shows another detailed cross-sectional view of the combustion gasket between the cylinder head and the cylinder liner, depicted in FIG. 17.

With regard to the drawing figures, FIGS. 1 and 2 show a perspective view of a crankcase with a water jacket providing targeted cooling around cylinder liners. FIGS. 3A-4B illustrate further perspective views of the crankcase with cylinder water jacket openings allowing coolant to circulate around the cylinder liners. FIG. 5 shows an engine system with a cylinder head attached to the crankcase via cylinder studs having an increased size to provide greater gasket compression. FIG. 6A shows a cross-sectional view of the engine system with water jacket passages extending through the crankcase and the cylinder head to increase engine cooling capabilities. FIG. 6B shows a detailed view of a combustion gasket, a fluid gasket, and an undercut fillet designed with increased durability as well as combustion and fluid sealing capabilities. FIG. 7 illustrates a detailed view of embodiments of the undercut fillet in the crankcase adjacent to a cylinder liner with a seal. FIGS. 8-11 show detailed views of the cylinder liner with a seal recess providing increased sealing capabilities. FIG. 12 shows an enlarged view of a combustion gasket designed to elastically deform and decrease the chance of gasket plastic deformation. FIGS. 13A and 13B show detailed views of the cylinder head with a stepped interface contoured to receive the combustion gasket and simplify engine assembly. FIG. 14 shows a detailed view of a scraper ring designed to mate with the cylinder liner and shaped to reduce the chance of improper installation. FIGS. 15 and 16 depict views of a fluid gasket decoupled from the combustion gasket and providing a robust seal for coolant and oil passages extending between the crankcase and the cylinder head. FIGS. 17, 18A, 18B, and 18C show views of the engine system with the combustion gasket and an undercut in the crankcase allowing for elastic deformation of the gasket to provide a reactive force resisting radial outward forces, decreasing the likelihood of permanent deformation of the gasket and gasket cracking. FIGS. 19 and 20 show detailed views of the combustion gasket demonstrating the resilient flexion of the combustion gasket under load.

FIGS. 1 and 2 show an example of an internal combustion engine system 100 with a crankcase 102. The engine system may be variously configured to deployed in a variety of platforms. Suitable platforms may include stationary platforms and mobile platforms. Suitable mobile platforms may include a vehicle. Suitable vehicles may include a rail vehicle, a marine vessel, an on-road vehicle, an off-road vehicle, mining and industrial equipment, and the like. Suitable stationary platforms may include a stationary power generator and the like. The engine may be designed to implement compression ignition and therefore may include a fuel delivery system, an intake system, and an exhaust system. In one embodiment, the fuel delivery system may deliver diesel fuel to the cylinders using conventional component such as fuel tanks, pumps, valves, and the like during engine operation. Utilizing compression ignition in the engine may increase engine fuel efficiency in comparison to similarly sized spark ignition engines. However, spark ignition engines may employ the inventive technique. Other suitable fuels may include biodiesel, natural gas, alcohol, kerosene, hydrogen, and the like, as well as combinations of two or more of the foregoing.

The engine system 100 shown in FIG. 1 includes cylinder studs 104 coupled thereto, while FIG. 2 omits the studs to reveal features obscured by the studs. When the engine is assembled, the cylinder studs may attach a cylinder head to the crankcase and compress seals interposed by a cylinder head and the crankcase.

The crankcase may include a plurality of cylinders 106. In the illustrated example, the cylinders may be arranged in banks 108, 110 with a V-arrangement. To elaborate, a first set of cylinders may be located in a first bank 108 on a first lateral side 112 of the crankcase and a second set of cylinders may be located in a second bank 110 on a second lateral side 114 of the crankcase. In such an example, the cylinder banks 108, 110 may be arranged at an angle less than 180 degrees. Thus, planes extending through the central axes 111 of each cylinder intersect one another. The central axes of the cylinders may also be referred to as cylinder axes (e.g., longitudinal cylinder axes). In each of the cylinder banks, the cylinders may be sequentially arranged from a first longitudinal side 116 of the engine to a second longitudinal side 118 of the engine. In other examples, an alternative cylinder arrangement in the engine may be used such as an inline cylinder arrangement, a horizontally opposed cylinder arrangement, etc. However, a V-type engine may have greater space efficiency and generate less vibration than engines with the aforementioned cylinder configurations.

The crankcase may include a water jacket 119 with passages 120 filled with coolant when in operation and fluidly coupled to a cooling system. As such, coolant may circulate through the crankcase as well as a cylinder head while the engine performs combustion. The cooling system may include conventional components such as pumps, radiators, valves, etc. to achieve the coolant circulation functionality. An axis system 150 with a z-axis, y-axis, and x-axis may be provided in FIGS. 1-2 and FIGS. 3A-20, for reference. The z-axis may be parallel to a gravitational axis, the y-axis may be a longitudinal axis, and the x-axis may be a lateral axis, in one embodiment. However, the axes may have different orientations, in other embodiments.

Figure 3A:
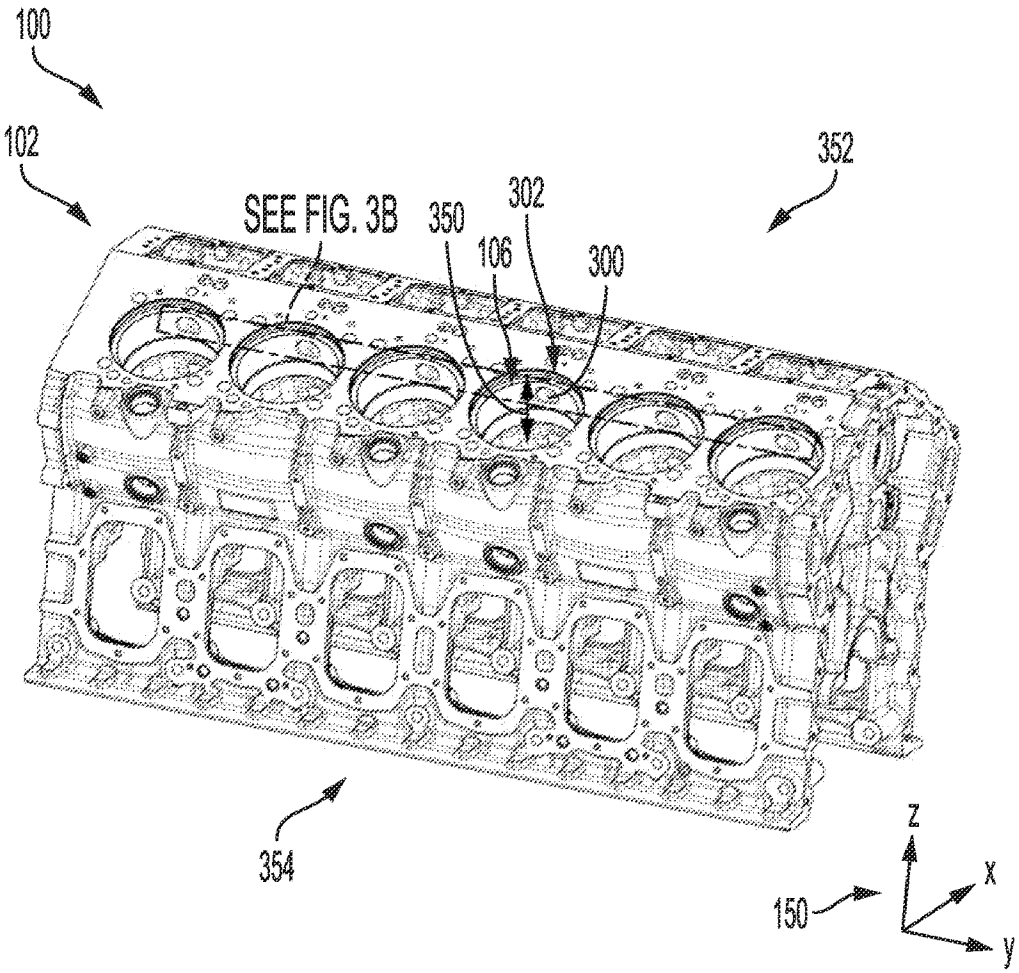
FIG. 3A shows another perspective view of the crankcase, depicted in FIG. 1.

FIG. 3A shows the engine system with the crankcase having water jacket openings 300. Each of the water jacket openings may be positioned on a first lateral side 302 (e.g., outboard side) of the corresponding cylinder 106. The openings may be inlets, and may guide coolant into passages around a cylinder liner.

A detailed view of one of the water jacket openings denoting a modification to the opening's profile may be shown in FIG. 3B. The modification to the profile of the opening is indicated at 304. As illustrated, an axial height 306 of the opening as measured from a central axis 350, shown in FIG. 3A, of the corresponding cylinder may be reduced in comparison to previous iterations. A radial direction may be any direction perpendicular to the central axis 350 of the cylinder and axial heights may be measured along the central axes of the cylinders. As described herein, an axially upward direction may be a direction along or parallel to a central axis of a cylinder pointing towards an upper side 352 of the engine system. Conversely, an axial downward direction may be a direction along or parallel to a central axis of a cylinder pointing towards a lower side 354 of the engine system 100.

The opening shown in FIG. 3B may be height reduced to allow the wall thickness of the crankcase to be increased. The structural integrity of the crankcase may be consequently increased. Increasing the thickness of the crankcase wall allows for profile modifications of an undercut fillet. The fillet's profile modifications enable the strength of the seal at the interface between the cylinder liner and the crankcase to be increased. To elaborate, increasing the crankcase wall thickness may allow a groove for a seal (e.g., O-ring) to be formed in the cylinder liner placed in the crankcase. The seal bolsters the system's sealing capabilities.

Figure 4A:
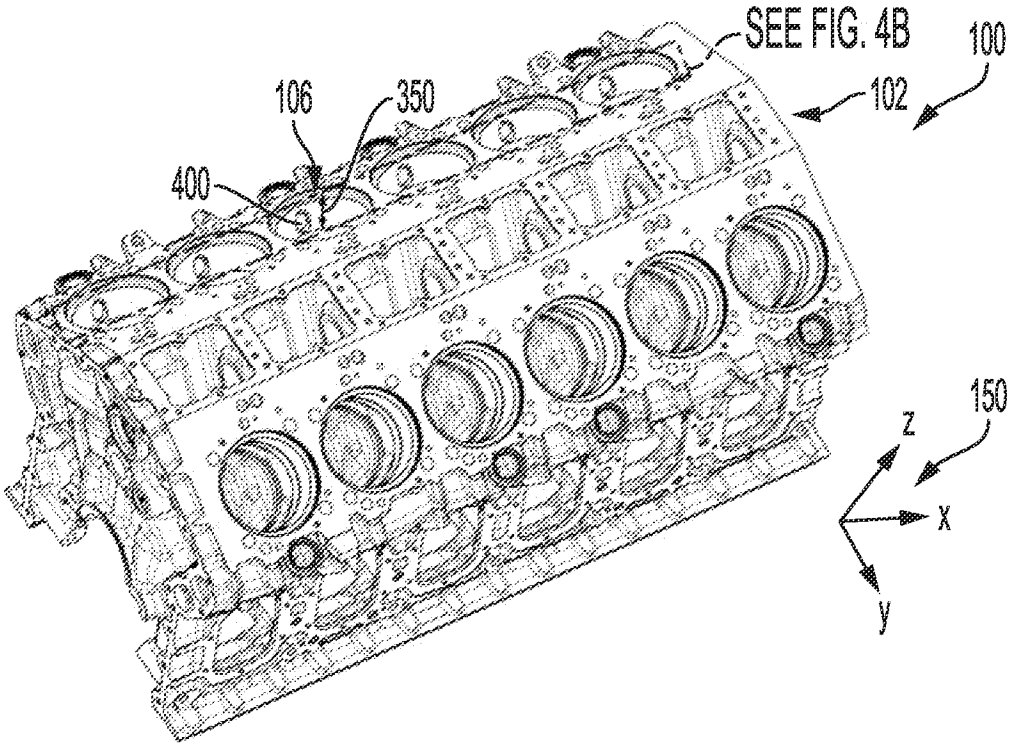
FIG. 4A shows another perspective view of the crankcase, depicted in FIG. 1.

FIG. 4A shows the crankcase with water jacket openings 400. Each of the water jacket openings 400 may be positioned on a second lateral side 402 (e.g., outboard side) of the cylinders. A detailed view of one of the water jacket openings denoting a modification to the opening's profile may be shown in FIG. 4B. The modification to the profile of the opening is indicated at 404. As illustrated, an axial height 406 of the opening 400 as measured from the central axis 350, shown in FIG. 4A, may be reduced in comparison to previous iterations. Again, the reduction in the height of the water jacket opening allows the crankcase wall thickness to be reduced to increase crankcase structural integrity and allow a groove for a seal (e.g., O-ring) to be formed in the cylinder liner, in some embodiments.

Additionally, the axial height 406 of the opening 400, shown in FIG. 4B, may be less than the height 306 of the opening 300, shown in FIG. 3B, to achieve a targeted amount of coolant flow around the cylinder liner. Designing the openings with this arrangement provides a desired cylinder cooling profile, in some implementations. The coolant flow pattern may be selected to reduce the chance of unwanted crankcase deformation stemming from imbalanced thermal loading, for instance.

FIG. 5 shows a cylinder head 500 in the engine system 100. The cylinder head 500 may be coupled to the crankcase via the studs 104. In one example, the studs may have a diameter 502 in a range that is greater than about 25.0 millimeters (mm). For instance, the stud may have a diameter of approximately 27.0 mm. The diameter of the studs may be selected based on factors such as gasket compression goals, the number of studs in the engine, and the layout of the studs. To elaborate, the diameter of the studs may be selected to achieve a desired amount of payload and contact pressures on the combustion and fluid gaskets.

A distance (e.g., longitudinal and lateral pitch) 502 between the centers of two of the studs is indicated in FIG. 5. The distance 504 may be between 195.0 mm and 205.0 mm. The engine may achieve a desired amount of gasket compression when spacing the studs in this manner. The distance 504 may be approximately 198.0 mm, in one embodiment. However, studs with alternate pitches may be used for engines with different expected cylinder pressures. FIG. 5 shows a cutting plane (line 6-6) indicating the cross-sectional view illustrated in FIG. 6A.

FIG. 6A illustrates a cross-section of the engine system 100 with the cylinder head 500 coupled to the crankcase. One of the cylinders may be again shown along with the water jacket 119 and passages 120. The central axis 350 of the cylinder may be shown for reference. One of the passages directs coolant around a cylinder liner 600, enabling a greater amount of heat to be removed from the cylinder. The cylinder liner may be seated in the crankcase and provides a sealing surface for rings of a piston. The cylinder liner may include an opening 601 forming a portion of the boundary of the cylinder. Cylinder head valve ports 602 and corresponding passages 604 may be shown in FIG. 6A. These ports and passages allow intake air to be introduced into the cylinder and exhaust gas to be expelled from the cylinder during combustion operation. The ports and passages may therefore be included in engine intake and exhaust systems.

A scraper ring 606 may be arranged in an inner step 608 of the cylinder liner. The scraper ring functions to remove oil or other suitable lubricant from the piston during combustion operation. The scraper ring 606 may include chamfered surfaces 607 on opposing axial sides of the ring. The likelihood of improper installation of the scraper ring may be reduced when the scraper ring may include two chamfered surfaces as opposed to one chamfered surface. The scraper ring's installation procedure may be therefore simplified when the ring has the dual-chamfered contour.

A seal 610 (e.g., O-ring) residing in a groove 612 of the cylinder liner is depicted in FIG. 6A. The seal 610 allows a stronger seal to be formed at an interface of the cylinder liner 600 and the crankcase. The likelihood of fluid leaks from the water jacket 119 may be consequently reduced. However, in alternate embodiments the seal may be omitted from the system.

FIG. 6B illustrates a detailed view of the engine system 100 including the cylinder head 500, the crankcase, the cylinder 106, the cylinder liner 600, the scraper ring 606, and the water jacket passages 120. One of the water jacket passages 120 may extend under a lower surface 614 of the crankcase and vertically upwards along a side surface 616 of the crankcase. The upwardly extending coolant passage in the crankcase crosses over to the cylinder head 500. A fluid gasket 618, interposed by the cylinder head 500 and the crankcase, fluidly seals the coolant cross-over passages.

In one embodiment, the engine system may include a combustion gasket 620 compressed by the cylinder head 500 and the crankcase. In the illustrated embodiment, the combustion gasket 620 may be spaced away and decoupled from the fluid gasket 618. To elaborate, the fluid gasket 618 may have a carrier (e.g., metal carrier) distinct from the combustion gasket 620. Decoupling the combustion and fluid gaskets enables the gaskets' properties to be granularly tuned to reduce the chance of combustion gas and coolant mixing and contaminating the coolant or combustion chamber. For instance, the fluid gasket 618 may include one or more elastomeric beads 621. These may seal around the water jacket passages. Spacing the fluid gasket beads away from the combustion chamber may reduce or eliminate a likelihood of bead cracking and other permanent deformation of the gasket. The combustion gasket may be designed to withstand greater thermal loading than the fluid gasket due to its proximity to the combustion chamber. For instance, the combustion gasket may be constructed out of a metal. Suitable metals may include steel, copper, tin, nickel, and lead as well as alloys of the foregoing. The metal may be multi-layered. Some metal gaskets may provide stronger combustion sealing but may be relatively more costly.

The seal 610 residing in the groove 612 of the cylinder liner 600 is depicted in FIG. 6B. The seal 610 forms a seal at the interface 623 between the cylinder liner 600 and the crankcase. The seal 610 may therefore be designed to compress when the engine may be assembly and may be constructed out of an elastomeric material. An undercut fillet 622 positioned below the seal 610 may be shown in FIG. 6B. The undercut fillet 622 may include a curved surface 624 and may be profiled to allow the seal to be incorporated into the cylinder liner 600. A landing surface 626 for the cylinder liner 600 may be shown in FIG. 6B. The landing surface 626 may allow stresses to be more evenly distributed between the cylinder liner 600 and the crankcase.

FIG. 7 shows a detailed view of two embodiments of the undercut fillet 622, shown in FIG. 6B, in the crankcase. To elaborate, a first embodiment of the undercut fillet is indicated at 700 and a second embodiment of the undercut fillet is indicated at 702. The first fillet embodiment 700 corresponds to the profile of the fillet 622, shown in FIG. 6B. In each of the embodiments illustrated in FIG. 7, the dimensions of the undercut fillet may be selected to allow a balance between gasket sealing capability and fatigue margins in the liner and crankcase to be struck. Therefore, undercut fillets having one or more of the structural features described below may balance these competing characteristics in a desired manner.

The first embodiment of the undercut fillet 700 may include a curved surface 704 which may be symmetric about a horizontal axis 706. Conversely, the second embodiment of the undercut fillet 702 has a curved surface 708 that may be asymmetric about a horizontal axis 710. The radius of curvature 712 of the first embodiment of the undercut fillet 700 may be approximately 2.5 mm. In one use case example, the radius of curvature 714 of the second embodiment of the undercut fillet 702 may be approximately 7.0 mm. In another use case example, the curved surface in the undercut may accommodate for thermal expansion and contraction of the cylinder liner, shown in FIG. 6B, during engine operation.

The second embodiment of the undercut fillet 702 illustrated in FIG. 7 may have an axial height 716 that may be less than or equal to 8.0 mm. Additionally, the radial length 718 of the landing surface 626 may be in the range of 110.0 mm to 120.0 mm. Specifically, in one example, the radial length 718 may be approximately 116.0 mm. The second embodiment of the undercut fillet 702 may have tangential surface 720 arranged at an angle 722. The angle 722 may be approximately 163 degrees, in one example. Additionally, a vertical surface 724 of the crankcase may be shown in FIG. 7 which may be offset from a radius of curvature of the undercut. A length of the offset is indicated at 726. In one particular use case the offset length 726 may be approximately 0.5 mm.

Figure 8:
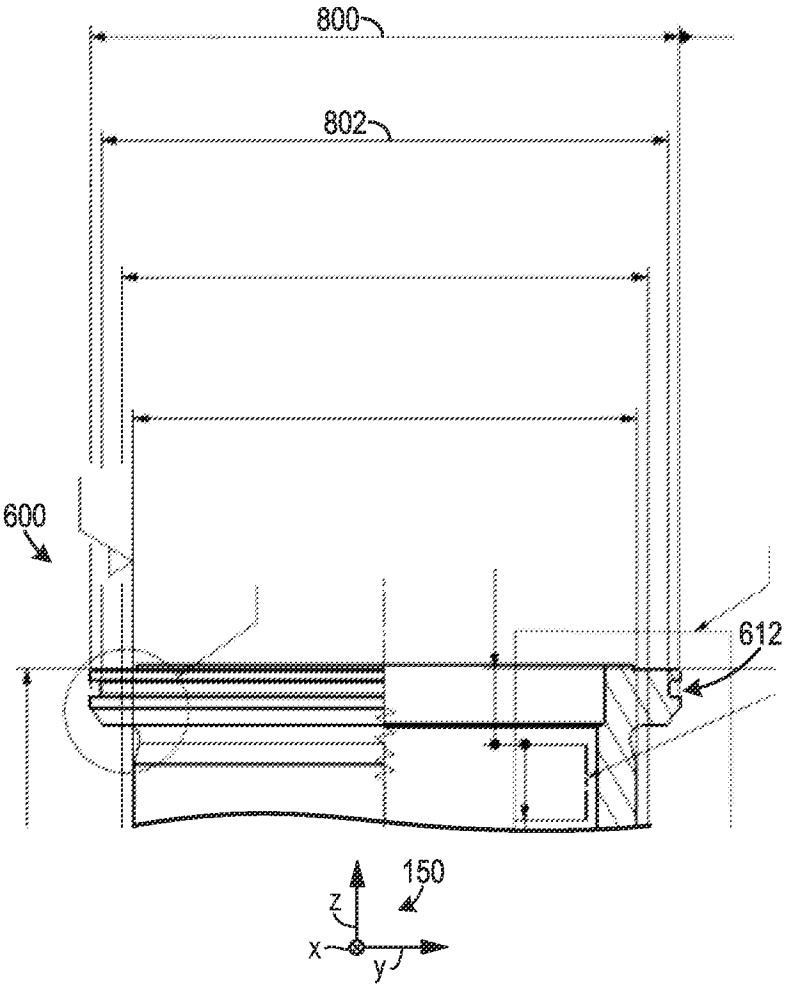

FIG. 8 shows a detailed view of the cylinder liner 600 with a portion of the liner in cross-section. The groove 612 for the seal 610, shown in FIG. 6B, is depicted in FIG. 8. The outer diameter 800 of the cylinder liner 600 is indicated in FIG. 8. The outer diameter 800 may be approximately 233.0 mm, in one use case example. An inner diameter 802 of the groove 612 may be shown in FIG. 8. The inner diameter 802 may be approximately 224.0 mm, in one embodiment. Profiling the cylinder liner in this manner allows the seal to be fitted in the liner and contact pressure to be more evenly distributed through the liner. However, liner profiles where the seal groove may be omitted have been envisioned.

Figure 9:
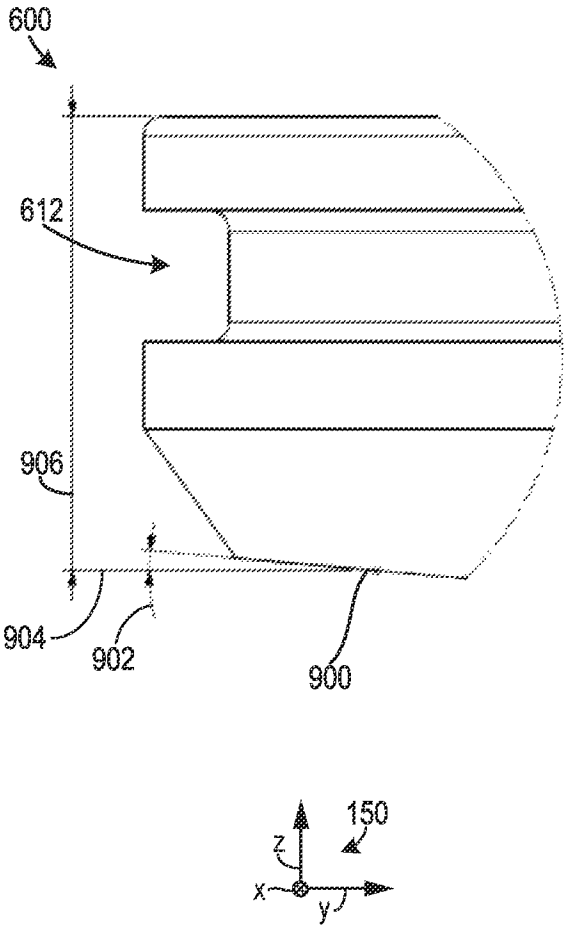
FIGS. 8-11 show detailed views of the cylinder liner in the engine system, depicted in FIG. 6B.

FIG. 9 again depicts the cylinder liner 600 with the groove 612. A surface 900 of the liner may be arranged at an angle 902, measured from a horizontal axis 904. The angle 902 may be exaggerated to allow the angle to be perceived in the view shown in FIG. 9. The surface 900 therefore biases the landing surface 626 of the crankcase, shown in FIG. 7. The angle 902 may be between 6 and 14 minutes. In one particular example, the angle may be approximately 10 minutes. Designing the surface 900 with this profile allows the liner to achieve more balanced stress distribution to increase the liner's durability and longevity. An axial height 906 of the flange 908 of the cylinder liner 600 is depicted in FIG. 9. The axial height 906 may be greater than 20.0 mm (e.g., approximately 22.0 mm), in some examples. By designing the liner flange with a height greater than 20.0 mm facilitates integration of the seal groove 612 into the liner.

Figure 10:
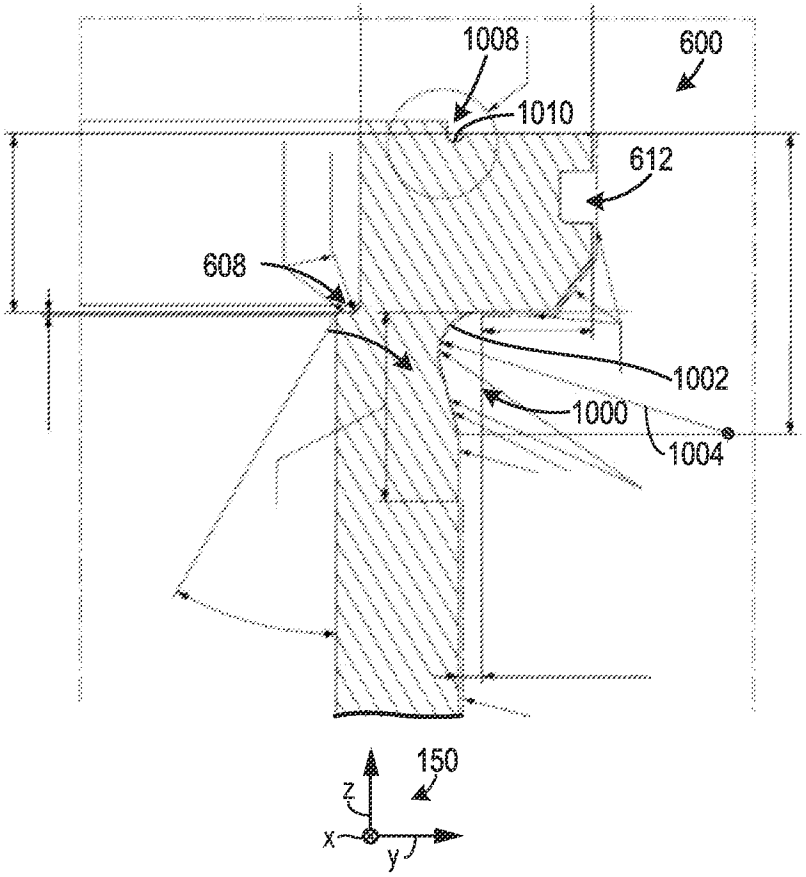

FIG. 10 shows yet another view of the cylinder liner 600. The cylinder liner 600 may include an undercut 1000 whose surface may be shot peened to increase liner fatigue strength, thereby increasing liner durability and lifespan. Shot peening may be a process for treating a material to produce a residual stress layer, thereby modifying the mechanical properties of the material. For instance, shot may strike the surface and create dimples on the surface during the shot peening process.

The undercut 1000 may include a lower surface 1002 which may be curved, in the illustrated embodiment. However, the surface may have a planar profile, in other embodiments. The radius of curvature 1004 of the surface 1002 may be approximately 5.5 mm, in some cases, which may provide a desired balance between structural integrity of the liner and accommodation for water jacket passages. However, other dimensions of the liner's undercut may be used, in alternate implementations, which may have a different liner structural integrity and water jacket passage cooling goals.

Additionally, FIG. 10 illustrates an inner step 608 of the cylinder liner 600 profiled to receive the scraper ring 606, shown in FIG. 6B. The height of the inner step 608 may therefore be greater than or equal to the height of the scraper ring. In this way, the scraper ring 606 may be mated in the inner step 608 of the cylinder liner 600.

FIG. 10 depicts an upper step 1008 in the liner 600 with an undercut 1010 adjacent to the upper step. The gasket 620, shown in FIG. 6B, may be placed in the upper step 1008 when the engine may be assembled. The upper step 1008 therefore functions to radially retain the gasket and may simplify gasket installation by providing a visual marker for the gasket's installation location. The undercut 1010 in the liner allows for temporary flexion of the gasket under load. Consequently, the chance of plastic deformation of the gasket may be reduced. The interaction between the gasket, the upper step, and the undercut may be described in greater detail herein with regard to FIGS. 18A-20.

Figure 11:
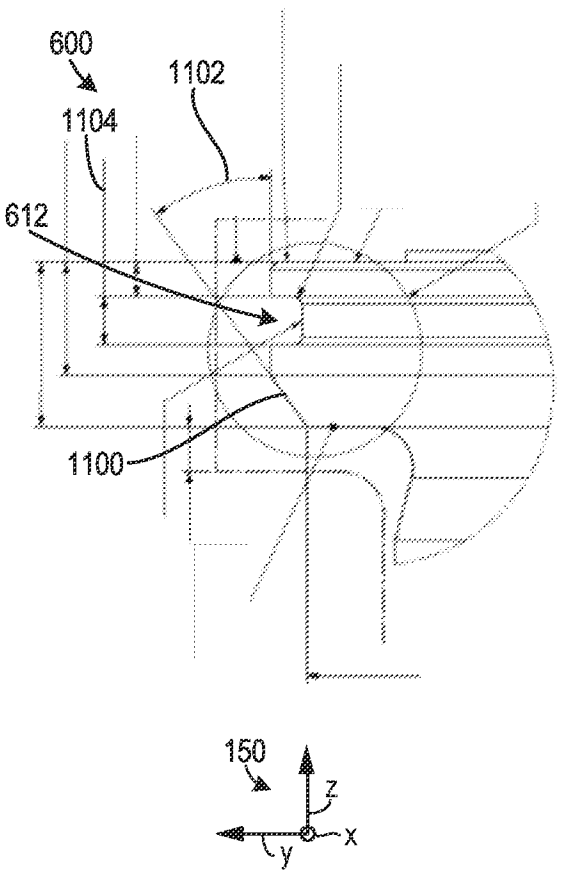

FIG. 11 shows the cylinder liner 600 with a chamfered surface 1100. An angle 1102 of the chamfered surface may be between 35 and 36 degrees, in one use case example. However, alternate chamfered surface angles have been contemplated as well as implementations omitting the chamfered surface 1100 in the cylinder liner 600. The chamfered surface 1100 may accommodate for thermal expansion and contraction of the liner during engine operation and allow the liner to smoothly mate with the crankcase during installation.

An axial width 1104 of the groove 612 may be illustrated in FIG. 11. The axial width 1104 may be between 6.0 mm and 7.0 mm, in one example. For instance, the axial width 1104 may be approximately 6.5 mm, in one use case example. The seal (e.g., O-ring) 610, shown in FIG. 6B, may have a similarly sized diameter accommodating for seal compression when the liner may be installed in the crankcase. Sizing the groove and seal in the aforementioned range allows the seal to provide a desired amount of sealing without unduly decreasing the structural integrity of the flange of the liner.

FIG. 12 shows the combustion gasket 620. An inner diameter 1200 and outer diameter 1202 of the combustion gasket 620 may be specifically illustrated. In one example, the inner diameter 1200 may be between 194.0 mm and 198.0 mm and the outer diameter may be between 208.0 mm and 212.0 mm. In one particular use-case example, the inner diameter 1200 may be approximately 196.1 mm and the outer diameter may be approximately 210.0 mm. Additionally, an axial thickness 1204 of the combustion gasket 620 may be shown in FIG. 12. The vertical thickness may be approximately 1.9 mm, in one example. The combustion gasket may achieve a desired load path and combustion sealing function when profiled in this manner. However, the combustion gasket may have an alternate profile in engines with alternative load path and sealing goals which may be selected based on expected cylinder pressure, expected cylinder head and crankcase operating temperature ranges, cylinder head and crankcase profile, etc.

FIG. 13A shows the cylinder head 500 with a lip 1300. The lip 1300 may be a stepped surface with an outer wall 1302, shown in FIG. 13B, extending between two surfaces (e.g., radially aligned surfaces) 1305, shown in FIG. 13B. The lip assists in containing the combustion gasket 620, shown in FIG. 6B, and when the gasket expands the lip may support the gasket at its outer diameter. An axial height 1314, shown in FIG. 13B, of the lip may therefore be equal to or slightly less than the axial height of the combustion gasket 620, shown in FIG. 6B, to allow for gasket compression, in one example. The lip reduces the chance of degradation (e.g., abrasive wear) to the fire deck 1303 during manufacture and transport of the cylinder head. For instance, the lip of the cylinder head 500 allows the head to be more easily handled and drives down the chance of unwanted contact between the fire deck 1303 and other components during transport and engine assembly.

Continuing with FIG. 13A, a diameter 1304 of the outer wall 1302 may be shown in FIG. 13A. A diameter 1306 of a surface 1308 bounding an inner side of the fluid gasket 618, shown in FIG. 6B, may be illustrated in FIG. 13A. The diameter 1304 may be approximately 212.5 mm, allowing the combustion gasket to be placed in the lip at a location that accommodates for gasket expansion. However, the lip may have another diameter in alternative examples, which may be chosen based on factors such as cylinder diameter, gasket size, expected cylinder pressure, etc. The diameter 1306 may be approximately 233.0 mm that may provide a desired spacing between the combustion and fluid gaskets. The diameter may have another value in alternative examples, which may be selected based on the aforementioned factors.

FIG. 13B shows a detailed view of the lip in the cylinder head 500. Additionally, a step 1310 may be included in the cylinder head 500. The step 1310 reduces the dead volume in the cylinder. Engine efficiency gains and emissions reductions may result from the reduction in the cylinder's dead volume. Additionally, an axial height 1312 of the step 1310 may be approximately 0.1 mm to achieve a desired amount of dead volume reduction in the cylinder, although other heights have been envisioned. The axial height 1314 of the lip 1300 may be shown in FIG. 13B. In one example, the height 1314 may be approximately 1.4 mm to achieve the aforementioned cylinder head handling characteristics. However, the height may be varied based on combustion gasket thickness, crankcase profile, expected combustion pressures, etc.

FIG. 14 shows the scraper ring 606 with the chamfered surfaces 607 at opposing sides of the ring. Designing the scraper ring with the dual-chamfer profile decreases the chance of improper gasket installation. For example, installation of the ring in an "upside down" arrangement can be avoided due to the gasket's symmetry with regard to the chamfers. The axial height 1400 of the chamfered surfaces 607 is indicated in FIG. 14. The axial height may be approximately 1.6 mm and an angle 1401 of the chamfered surfaces may be approximately 45 degrees to allow the ring to mate in the cylinder liner and interface with the cylinder head. However, the height and angle of the chamfered surface may be adjusted based on the geometry of the cylinder liner, the geometry of the cylinder head, expected scraper ring loading, etc. The axial height 1402 of the scraper ring 606 is depicted in FIG. 14. The axial height 1402 may be approximately 24.3 mm, to achieve desired oil removal capabilities. However, the scraper ring's height may be adjusted based on factors such as cylinder liner profile, expected cylinder pressure, cylinder head profile, etc.

FIG. 15 shows the fluid gasket 618. The fluid gasket 618 may include coolant openings 1500 and lubricant openings 1502. The fluid gasket 618 may further include an air and aerated lubricant opening 1503, in one example. Extending around the periphery of the coolant, lubricant, and/or air and aerated lubricant openings 1500, 1502, 1503 may be one or more elastomeric beads 621 coupled to a carrier 1504. The carrier 1504 may extend circumferentially around a cylinder opening 1505. The elastomeric beads may be constructed out of a suitable material and selected based on application specific parameters. Suitable materials may include thermoset or thermoplastic polymers. Suitable thermoplastic materials may include a fluorocarbon polymer (FKM). Suitable thermoset materials may include vulcanized materials. The elastomeric bead may be unfilled or filled. If filled, suitable fillers may include glass beads or grains, metal particles, or ceramic particles. Suitable metals may include those that may be relatively soft, and may have a coefficient of thermal expansion (CTE) design to match or to compliment the CTE of the engine components being sealed.

FIG. 16 shows a cross-sectional view of the fluid gasket 618. The elastomeric beads extending from the carrier 1504 may be again illustrated. To elaborate, the elastomeric beads include two upper beads 1600 extending vertically upward from the carrier 1504 and two lower beads 1602 extending vertically downward from the carrier. In the illustrated example, the upper beads and the lower beads may be asymmetric about axes 1604 parallel to the central axis of the cylinder. When assembled an exhibiting this profile, the upper and lower beads compress and deform to create a strong fluid seal for coolant and the lubricant. However, at least a portion of the beads may have symmetric profiles, in other examples. The upper and lower beads may extend around an interior edge 1606 of the carrier 1504 to provide stronger sealing, in some examples.

Figures 17, 18A, 18B, 18C:
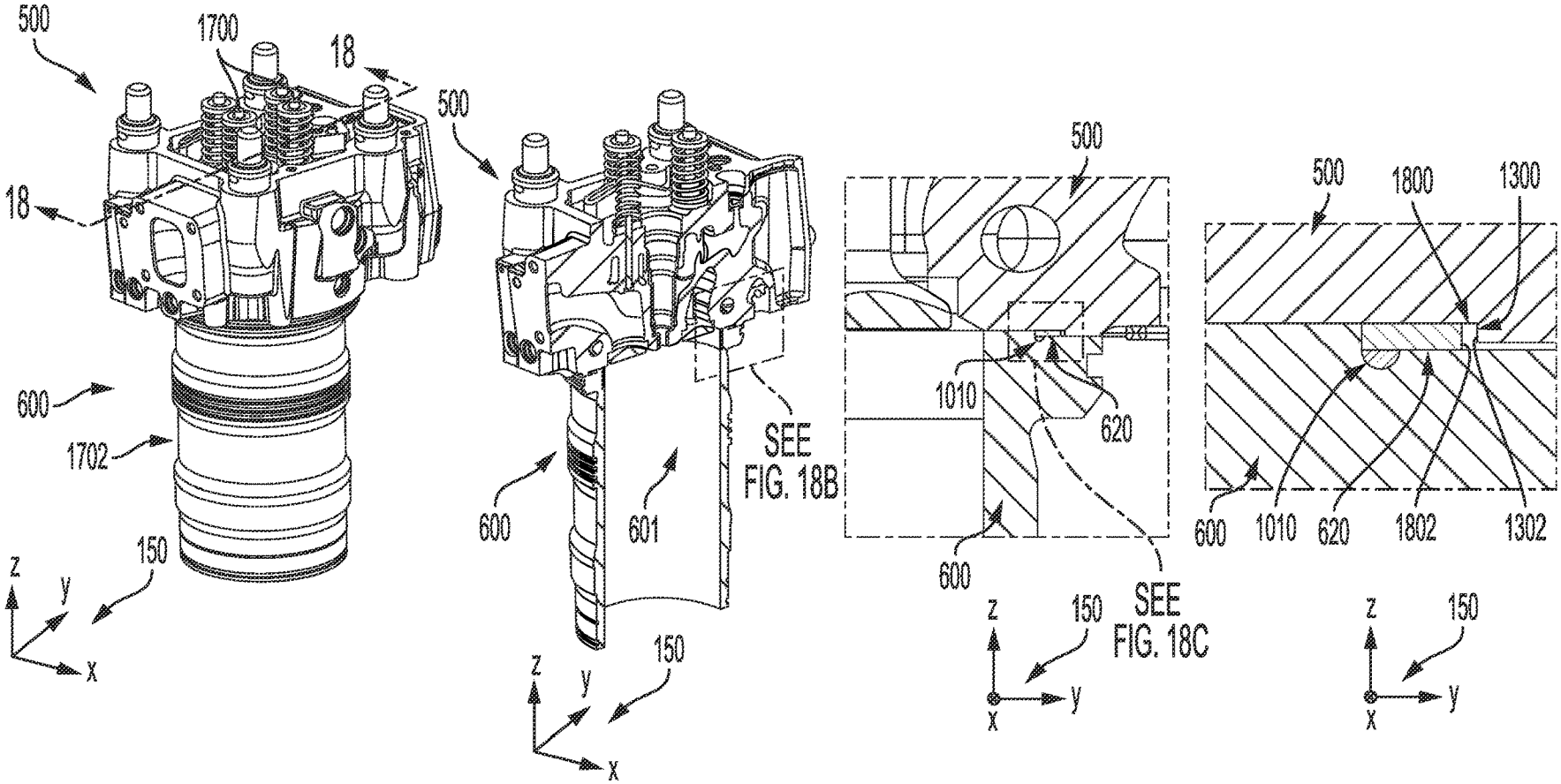
FIG. 17 shows a perspective view of the cylinder liner and the cylinder head in the engine system, depicted in FIG. 6B.
FIGS. 18A, 18B, and 18C show detailed cross-sectional views of the combustion gasket between the cylinder head and the cylinder liner, depicted in FIG. 17.

FIG. 17 illustrates a perspective view of the cylinder head 500 and the cylinder liner 600. Valves 1700 may be shown extending through the cylinder head 500. A recess 1702 circumferentially surrounding the cylinder liner 600 is depicted in FIG. 17. When the engine may be assembled and in operation, the recess 1702 serves as a boundary of a coolant channel routing coolant around the cylinder. FIG. 17 shows a cutting plane (line 18-18) indicating the cross-sectional views illustrated in FIGS. 18A-20.

FIG. 18A shows a cross-sectional view of the combustion gasket between the cylinder head and the cylinder liner with the cylinder opening. FIG. 18B shows a more detailed view of the combustion gasket. The combustion gasket has a polygonal cross-section. In one embodiment, the gasket may have a rectangular cross-sectional profile to enable temporary gasket deflection into the undercut when loaded.

FIG. 18C another detailed view of the combustion gasket. In the engine system, a gap 1800 may be formed between an outer radial side 1802 of the combustion gasket 620 and the outer wall of the lip. The gap may allow the combustion gasket to expand during engine operation. Expansion may be caused, at least in part, by heating and may depend on the CTE of the gasket material. The CTE may be tailored by selecting the gasket material, the filler material (if any), and the concentration of the filler (if present).

FIG. 19 depicts the combustion gasket 620 in an unloaded state while FIG. 20 shows the gasket in temporary flexion during loading. When in flexion, an inner radial side 2000 of the combustion gasket moves axially downward into the undercut 1010. This gasket flexion allows localized contact pressure at the cylinder head near the flexed section to be reduced while maintaining a desired pressure across the gasket's radial width 2001. During gasket flexion, sections of the upper and lower surfaces 2004, 2006 therefore remain in face sharing contact with the cylinder head and the crankcase, respectively. Arrows 2002 indicate this force distribution. The downward flexion of the combustion gasket therefore softens the edge effect of the contact pressure. Deflection of the combustion gasket during thermal and mechanical loading of the gasket may reduce or eliminate the likelihood of plastic deformation of the combustion gasket and gasket cracking stemming from the plastic deformation. One or more of these effects may be influenced by the selection of gasket material. The deformed shape of the combustion gasket, shown in FIG. 20, may provide a reactive point to resist radial outward force and therefore decreases gasket migrations in a radial outward direction. In this way, movement of the outer radial side 1802 toward the lip may be constrained. Consequently, the combustion gasket's durability and longevity may be increased.

FIGS. 1-20 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example. FIGS. 1-20 are drawn approximately to scale, although other dimensions or relative dimensions may be used. However, as previously mentioned, the angle 902 shown in FIG. 9 is not drawn to scale. As used herein, the terms "approximately" is construed to mean plus or minus two percent unless otherwise specified.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. An internal combustion engine system, comprising:

a cylinder liner positioned within an opening of a crankcase, the cylinder liner including a surface biasing a landing surface of an undercut fillet of the crankcase and further including a cylinder opening, wherein the undercut fillet includes a curved wall extending radially outward from a central axis of the cylinder opening and adjoins a vertical surface in the crankcase;

a seal arranged in a groove of the cylinder liner, the seal positioned above the landing surface with regard to a central axis of a cylinder and spaced away from the cylinder; and a water jacket traversing the crankcase and including a passage with a first portion that is positioned below the undercut fillet with regard to the central axis and a second portion positioned radially outward from the undercut fillet with regard to the central axis.

2. The internal combustion engine system of claim 1, wherein the passage of the water jacket extends between the crankcase and a cylinder head.

3. The internal combustion engine system of claim 1, further comprising a scraper ring positioned in an inner step of the cylinder liner, wherein the scraper ring includes chamfered surfaces on opposing axial sides.

4. The internal combustion engine system of claim 1, wherein the passage of the water jacket includes a first opening and a second opening, each of the first and second openings configured to guide coolant through a coolant channel between the cylinder liner and the crankcase, wherein the first opening has a greater axial height than the second opening.

5. The internal combustion engine system of claim 1, wherein the undercut fillet is asymmetric about a radially aligned axis.

6. The internal combustion engine system of claim 1, wherein the undercut fillet is symmetric about a radially aligned axis.

7. The internal combustion engine system of claim 1, wherein the internal combustion engine system is arranged in an engine, wherein the engine is a compression ignition engine and a V-type engine.

* * * * *